United States Patent [19]

Coon, deceased et al.

[11] 3,996,024

[45] Dec. 7, 1976

[54] FUEL COMPOSITION

[75] Inventors: Marvin D. Coon, deceased, late of Vallejo, Calif.; Phyllis B. Coon, administratrix, Bakersfield, Calif.

[73] Assignee: Chevron Research Company, San Francisco, Calif.

[22] Filed: June 22, 1973 (Under Rule 47)

[21] Appl. No.: 372,738

[52] U.S. Cl. ..... 44/71; 252/392

[51] Int. Cl. ..... C10l 1/22

[58] Field of Search ..... 44/66, 71; 252/392

[56] References Cited

UNITED STATES PATENTS

| | | | |
|---|---|---|---|
| 3,313,607 | 4/1967 | Gasfon | 44/66 X |
| 3,438,757 | 4/1969 | Honnen et al. | 44/72 X |
| 3,454,607 | 7/1969 | LeSuer et al. | 44/66 X |
| 3,565,592 | 2/1971 | Mehmedbasich | 44/71 |
| 3,565,804 | 2/1971 | Honnen et al. | 44/63 |
| 3,778,372 | 12/1973 | Murphy | 252/51.5 A |
| 3,846,481 | 11/1974 | Gaydasch | 44/71 |

*Primary Examiner*—Delbert E. Gantz
*Assistant Examiner*—I. Vaughn
*Attorney, Agent, or Firm*—G. F. Magdeburger; C. J. Tonkin

[57] ABSTRACT

Monocarboxylic acid salts of hydrocarbyl amines are provided, which function as rust inhibitory and dispersant hydrocarbon fuel additives, wherein the hydrocarbyl substituent contains from 30 to about 300 carbon atoms.

8 Claims, No Drawings

FUEL COMPOSITION

BACKGROUND OF THE INVENTION

Much modern research into fuel compositions for the internal combustion engine has for its principal goal the promotion of longer engine life with less maintenance and better performance. This goal is partly achieved by the use of fuel additives which maintain cleaner engines by inhibiting the formation of valve deposits and crankcase sludge. The prevention of fuel system rusting also provides better service from the engine.

Belgium Pat. No. 777,012 relates the process for the preparation of a salt of a polyamine suitable for use in oil and fuel compositions. U.S. Pat. No. 3,033,665 discloses the use of low molecular weight quarternary ammonium salts in gasoline fuel compositions. E. Mehmedbasich in U.S. Pat. Nos. 3,573,010 and 3,565,592 reports mineral acid salts, and aliphatic polycarboxylic acid salts, of certain high molecular weight aliphatic hydrocarbyl-substituted polyamines, are fuel detergents having good water tolerance.

SUMMARY OF THE INVENTION

The fuel composition contains a major amount of a liquid hydrocarbon fuel and from 10–1500 ppm of a fuel detergent which is the salt of a hydrocarbyl amine, wherein the hydrocarbyl substituent contains from 30 to about 300 carbon atoms, and a $C_1$-$C_{30}$ monocarboxylic acid. In the present invention it is found that certain monocarboxylic acid salts of hydrocarbyl amines are unexpectedly superior fuel additives in performance. It is not required that these monocarboxylic acids themselves be particularly oil-soluble.

DESCRIPTION OF THE PREFERRED EMBODIMENTS

The fuel additive of the present invention is a monocarboxylic acid salt of a hydrocarbyl amine. Hydrocarbyl as used herein denotes an organic radical, solely composed of carbon and hydrogen except for minor, insubstantial, sometimes adventitious amounts of other elements such as chlorine and oxygen. The hydrocarbyl group may be aliphatic, alicyclic, aromatic or combinations thereof, e.g., aralkyl. Preferably, the hydrocarbyl group is relatively free of aliphatic unsaturation, i.e., ethylenic and acetylenic, particularly acetylenic unsaturation. The hydrocarbyl substituent contains at least 30 carbon atoms and, preferably, less than about 300 carbon atoms. The hydrocarbyl group is preferably aliphatic, having preferably 0 to 2 sites of ethylenic unsaturation and most preferably from 0 to 1 such site. Hydrocarbyl groups derived from a polyolefin, itself derived from olefins (normally 1-olefins) of from 2 to 6 carbon atoms (ethylene being copolymerized with a higher olefin), or from a high molecular weight petroleum-derived hydrocarbon are preferred, and of these, polyisobutene is most preferred.

Illustrative sources for the high molecular weight hydrocarbyl substituent are petroleum mineral oils, such as naphthenic bright stocks, polypropylene, polyisobutylene, poly-1-butene, copolymers of ethylene and propylene, poly-1-pentene, poly-4-methyl-1-pentene, poly-1-hexene, poly-3-methylbutene-1, etc.

The hydrocarbyl amine is derived from monoamines and polyamines, preferably alkylene polyamines and polyalkylene polyamines by, for example, the reaction of a halogenated hydrocarbon with an amine. Examples of such an amine include piperazine, ethylene diamine, 2-aminoethyl piperazine, diethylene triamine, methylamine, di(trimethylene)-triamine, decylamine, dipropylene triamine, triethylene tetramine, tripropylene tetramine, tetradecylamine, tetraethylene pentamine, pentaethylene hexamine, etc. The amine encompasses isomers such as branched chain polyamine, and hydroxyalkyl-substituted and alkyl-substituted amine, e.g., N-methyl ethylene diamine, N,N'-dimethyl ethylene diamine, N,N-dimethyldiaminopropane, N-hydroxyethyl ethylene diamine, etc. Amine having up to about 12 amino nitrogens and up to about 30 carbon atoms is especially preferred. The hydrocarbyl amine is prepared, in general, by the reaction of a halogenated hydrocarbon with the amine. Details of such preparations and further descriptions of certain hydrocarbyl amines and methods of preparing them can be found in U.S. Pat. Nos. 3,565,804 and 3,671,511.

The hydrocarbyl substituent in a hydrocarbyl polyamine can be found at any nitrogen atom which is capable of receiving it. These nitrogen atoms are, in general, inequivalent by symmetry. The subtituted polyamine which finds use in the present invention is a mixture of mono- and poly-substituted polyamines with hydrocarbyl groups substituted at various equivalent and/or inequivalent nitrogen atoms. The reaction which yields the hydrocarbyl amine salt can occur at any nitrogen atom or several nitrogen atoms. Consequently, it is impractical to try to express the hydrocarbyl amine salt in terms of a single structure or class of structures.

In many instances, a single compound will not be used as a reactant in the preparation of the compositions of this invention. That is, mixtures will be used in which one or two compounds will predominate and the average composition or molecular weight is indicated. For example, tetraethylene pentamine can contain both lower and higher members, e.g., triethylene tetramine and pentaethylene hexamine, but the composition will be mainly tetraethylene pentamine and the empirical formula of the total composition will closely approximate that of tetraethylene pentamine. Similarly, the molecular weight, or carbon number, reported for the hydrocarbyl substituent in an average property (number average molecular weight) of the hydrocarbon mixture.

The monocarboxylic acid is a $C_1$-$C_{30}$ aliphatic, alicyclic or aromatic acid. Preferably the carboxylic acid is written according to the general formula XCOOH, denoting a carboxylic acid group with a monovalent substituent, X, which is hydrogen or an aliphatic, alicyclic, aromatic, or hydroxyl group, and which can contain up to about 30 carbon atoms. Examples of such substituents are alkyl, aryl, alkaryl, cycloalkyl, alkylhydroxy and hydroxyl groups. Examples of such monocarboxylic acid include, but are not limited to, formic acid, acetic acid, butyric acid, undecanoic acid, lauric acid, stearic acid, oleic acid, linoleic acid, rincinoleic acid, benzoic acid, lactic acid, carbonic acid, glycine, alanine, valine, and so forth.

In order to prepare the salt of the present invention, the organic acid and hydrocarbyl amine are combined in a suitable medium in appropriate proportions based on the amount of titratable amino nitrogen in the hydrocarbyl amine. The salt is generally prepared similarly to the description in U.S. Pat. No. 3,565,592. Useful media include alcohols, mixtures of alcohols, hydrocarbona, etc., such as tert.-butyl alcohol, toluene, and xylene. The relatively volatile media may be removed and the product isolated, if desired, by stripping. By a suitable choice of solvent, the product may be obtained directly as a concentrate for use in combining with fuels. The amount of titratable nitrogen is determined, for example, by a potentiometric titration of the hydrocarbyl amine in a suitable solvent with 0.1 N HCl or perchloric acid, by graphing the course of the titration and taking the inflection point of the curve (pH of about 5.3) to determine the amount of titratable nitrogen. An equivalent, or excess, amount of acid is added to the hydrocarbyl amine to obtain the 100 percent neutralized hydrocarbyl amine salt. Each mol of monocarboxylic acid is presumed to contain one equivalent of acid. Less than an equivalent amount of acid is used to obtain the 75 percent neutralized hydrocarbyl amine salt, the 50 percent neutralized hydrocarbyl amine salt, etc. The hydrocarbyl amine salt which finds use within the scope of the present invention is 10–100 percent neutralized, preferably 50–100 percent neutralized, and most preferably, a 75–100 percent neutralized salt of the monocarboxylic acid. A 75 percent neutralized salt, for example, is neutralized to the extent of 0.75 times the amount of titratable amine nitrogen.

EXAMPLE 1

2,000 g (1340 meq.) of polyisobutenyl ethylene diamine (60 percent in aromatic solvent, Base No. 37.8 mg KOH/g, 0.675 meq./g, average molecular weight about 1400) and 1680 meq. of 88 percent formic acid dissolved in 200 g of n-butanol, were combined with stirring. The amount of active dispersant product was calculated to be 55.7 percent by weight.

EXAMPLE 2

Polyisobutenyl ethylene diamine as described in Example 1 (750 g) was combined with 200 ml of mixed hexanes, 200 ml of isopropyl alcohol, and 100 ml of water. The mixture was heated to 70° C. with stirring. Heating was stopped and carbon dioxide introduced until the temperature dropped to 30° C. The mixture was poured into a separatory funnel and 20 ml of n-butanol was added. The mixture was allowed to stand overnight and the lower aqueous layer was removed and discarded. The organic phase was poured into an open beaker and allowed to stand overnight to yield 941 g of product. The amount of active dispersant in the product was calculated to be 48.0 percent. When a sample of this material was shaken with dilute HCl, foaming and evolution of $CO_2$ was observed.

EXAMPLE 3

500 g (337 meq.) of the polyisobutenyl ethylene diamine was heated to 60° C. with stirring. Glacial acetic acid (20.2 g, 337 meq.) in enough isobutyl alcohol to make 100 g was added to the hot stirred mixture. The product was allowed to cool to room temperature before using. The amount of active dispersant in the product was calculated to be 53.5 percent.

EXAMPLE 4

The procedure of Example 3 was repeated using lactic acid (30.3 g, 337 meq.) to give a product containing 55.0 percent active dispersant by calculation.

EXAMPLE A

The procedure of Example 3 was repeated, using oxalic acid dihydrate (21.2 g, 337 meq.). The product was calculated to be 53.5 percent active.

EXAMPLE B

The procedure of Example 3 was repeated using citric acid monohydrate (23.6 g, 337 meq.) to give a product calculated to be 54.5 percent active.

In the Examples, and throughout the specification, the average molecular weight of a hydrocarbyl group can be related to its average carbon number, with sufficient accuracy, by dividing the average molecular weight by 14. Illustrative examples of hydrocarbylamine salts which find use within the scope of the present invention are also exemplified by:

EXAMPLE I

The salt of polypropenyl dimethyl propane diamine, wherein the polypropenyl group is of 4,000 average molecular weight, and acetic acid.

EXAMPLE II

The salt of stearic acid and a polybutenyl ethylene diamine wherein the polybutenyl group is of average molecular weight 1,400.

EXAMPLE III

The salt of lactic acid and polyisobutenyl ethylene diamine derived from polyisobutylene having an average carbon number of 100.

EXAMPLE IV

The salt of acetic acid and polypropenyl N′, N-dimethyl tetraethylene pentamine derived from a polypropylene of about 350 average molecular weight.

EXAMPLE V

The salt of stearic acid and polyisobutenyl methyl amine, wherein the polyisobutenyl group is of 4,200 average molecular weight.

COMPOSITIONS

The fuel is a liquid hydrocarbon fuel boiling in the gasoline and diesel oil range, e.g., having ASTM D-86 90 percent points of about 200° F. to about 700° F., and generally boiling from about 100° F. to about 750° F.

Depending upon the particular application of the compositions of this invention, the reaction may be carried out in the medium in which it will find ultimate use and be formed in concentrations which provide a concentrate of the fuel additive. Thus, the final mixture may be in a form to be used directly in dilution in fuels. The hydrocarbyl amine salts will generally be employed in hydrocarbon liquid fuels. They may be formulated as a concentrate, using a suitable solvent, preferably an aromatic hydrocarbon solvent such as benzene, toluene, xylene or higher boiling aromatics or aromatic thinners. Aliphatic alcohols of about 3–5 carbon atoms, such as isopropanol, isobutanol, n-butanol, and the like, sometimes in combination with hydrocarbon solvents, are also suitable for use with the hydrocarbyl amine salt additive. Other polymeric materials may be used in conjunction with the additives of this invention, e.g., polyisopropylene.

In the fuel, the concentration of the hydrocarbyl amine salt will generally be at least 10 ppm, and usually not more than 4,000 ppm, more usually in the range of from about 50 to about 1,500 ppm. In fuel concentrates, they will generally be from 1 to 90 weight percent, more usually from about 5–60 weight percent, and more generally not exceeding 80 weight percent.

In gasoline fuels, other fuel additives may also be included such as anti-knock agents, e.g., tetramethyl lead or tetraethyl lead. Also included may be lead scavengers such as the aryl halides, e.g., dichlorobenzene or alkyl halides, e.g., ethylene dibromide; and oxidation inhibitors such as alkylated phenols, e.g., 2,6-dibutylparacresol, or aromatic amines such as N,N'-dibutyl phenylene diamines.

A non-volatile lubricating mineral oil, e.g., petroleum spray oil, particularly a refined lubricating oil, preferably having a viscosity at 100° F of 1,000–2,000 SUS, is a suitable oil-additive for the gasoline composition used with the hydrocarbyl amine salts of this invention and its use is preferred. Polymeric materials, as mentioned above, such as polyolefins and glycols, such as polypropylene glycol, can also be used. These oils and polymers are believed to act as the carrier for the additive and assist in removing and preventing deposits. They are employed in amounts of from about 0.05 to 0.5 percent by volume, based on the final gasoline composition.

EVALUATION

Illustrative additives of the present invention were subjected to comparitive testing. Monocarboxylic acid salts of a polyisobutenyl amine were compared as fuel additives to the polyisobutenyl amine itself, and to polycarboxylic acid salts of the same amine.

To determine the effect of these fuel additives on intake valve deposits, they were subjected to the 10-Hour Intake Valve Deposit Test. The engine used in this test is a Waukesha ASTM-CFR single-cylinder engine. Upon completion of the test, the intake valve is removed, washed with hexane and weighed. The deposits are removed with a wire brush and the valve is reweighed. The difference between the two weights is the weight of the deposits given in Table I in milligrams. The Intake Valve Deposit Test was performed at 250 ppm of additive in the fuel. In this test, the engine speed is 1,800 rpm, the water temperature is 212° F., the manifold vacuum is 15 inches of Hg, the mixture temperature is 125° F., the air-fuel ratio is 14, the ignition spark timing is 15° BTC, the fuel contained 1000 ppm of carrier oil, and the crankcase oil is a Chevron commercial 30W oil.

TABLE I

| Intake Valve Deposit Test | |
|---|---|
| Additive | Washed Deposits |
| None | 90 mg |
| Polyisobutenyl amine[a] | 14 mg |
| Polyisobutenyl amine formate | 19 mg |
| Polyisobutenyl amine formate[b] | 41 mg |
| Polyisobutenyl amine carbonate | 6 mg |

[a]Polyisobutenyl ethylene diamine, wherein polyisobutenyl is of 1400 average molecular weight
[b]Only 50 percent neutralized Presented in Table II are the 8-Hour Engine Dispersancy test (EDT) results. This test is conducted in a 1962 Chevrolet 6-cylinder 235-CID engine, using a test gasoline and a 480 neutral base oil containing 50 mM/kg of zine dithiophosphate. The test duration is 8 hours under the following operating cycle: time, seconds/engine load, bhp/rpm are 10/idle/700, 50/75/2,500, 30/idle/700, 150/75/2,500; water temperature, 110° F.; and oil temperature, 180° F. At the completion of each test, the used oil is analyzed for the amount of pentane insolubles. The smaller the amount of insolubles the better the dispersancy of the fuel additive. 10 ml of the oil is diluted to 50 ml with 0.45 micron-filtered pentane and filtered through a 3-micron filter, followed by washing with pentane until oil-free and drying in an oven at 200° F. for 10 minutes. The amount of insolubles is reported in milligrams per 10 ml of used oil. The test is run at 50 ppm of additive in the fuel. In the EDT, the fuel contained 200 ppm of carrier oil.

TABLE II

| Engine Dispersancy Test | |
|---|---|
| Additive | Pentane Insolubles[a] mg |
| None | 37 |
| Polyisobutenyl amine[b] | 33 |
| Polyisobutenyl amine carbonate[c] | 20 |

[a]Pentane insolubles in 10 ml of oil. Average of three determinations, in milligrams.
[b]See Footnote a of Table I. At 50 ppm in fuel.
hu cExample 2 at 50 ppm in fuel.

The results of Table I show the remarkable effect of the additives of the present invention on the reduction of intake valve deposits. These intake valve results are considered at least equivalent to, and sometimes better than, the results obtained from the known fuel additive, polyisobutenyl amine. As shown in the Engine Dispersancy Test of Table II, the salt of the present invention is superior to the hydrocarbyl amine itself in dispersancy. It is believed that more of the acid salt is permitted to reach the crankcase in condition to act as a dispersant than is true of the hydrocarbyl amine itself.

The ASTM D-665 Rust Prevention Test was used to evaluate the additives. The conditions were as follows: Duration, 20 hours; temperature, 100° F., water, tap water. The additives were tested at a concentration in unleaded gasoline of 200 ppm of active dispersant. The following rating system was used: Zero rust, no rust observed; light rusting, covering no more than 5 percent of the spindle area; moderate rusting, covering from 5–25 percent of this area; severe rusting, covering greater than 25 percent of the area.

TABLE III

| ASTM D-665 Rust Test | |
|---|---|
| Additive | Rusting Severity |
| None | Severe |
| Polyisobutenyl amine[a] | Light |
| Polyisobutenyl amine oxalate[b] | Severe |
| Polyisobutenyl amine citrate[c] | Severe |
| Polyisobutenyl amine acetate[d] | Light |
| Polyisobutenyl amine lactate[e] | Light |
| Polyisobutenyl amine formate[f] | Light |
| Polyisobutenyl amine carbonate[g] | Light |

[a]See Footnote a of Table I.
[b]Example A.
[c]Example B.
[d]Example 3.
[e]Example 4.
[f]Example 1.
[g]Example 2.

The rust data on the monocarboxylate salts of polybutene amine show that they are superior in rust prevention in comparison to the polycarboxylate salts of the same amine.

While the character of this invention has been described in detail with several examples, this has been done by way of illustration rather than limitation. It is apparent to those skilled in the art that numerous modifications and variations of the illustrative examples can be made in the practice of this invention.

What is claimed is:

1. A fuel composition comprising a major amount of a liquid hydrocarbon fuel and from 10 ppm to 1,500 ppm of the salt of a hydrocarbyl-substituted amine, wherein said hydocarbyl substituent contains from 30 to 300 carbon atoms, and an acid selected from formic, carbonic, acetic and lactic acid.

2. A fuel composition comprising a major amount of a liquid hydrocarbon fuel and from 10 ppm to 1,500 ppm of the salt of a hydrocarbyl-substituted alkylene polyamine, wherein said hydrocarbyl substituent contains from 30 to about 300 carbon atoms, and an acid selected from formic, carbonic, acetic and lactic acid.

3. A fuel composition according to claim 1 wherein said hydrocarbyl substituent is derived from a polyolefin, itself derived from $C_2$–$C_6$ olefins, with the proviso that ethylene is copolymerized with a higher olefin.

4. A fuel composition according to claim 1 wherein said hydrocarbyl substituent is derived from polybutylene or polypropylene.

5. A fuel composition according to claim 2 wherein said hydrocarbyl-substituted alkylene polyamine is selected from the group consisting of polyisobutenyl ethylene diamine, polyisobutenyl diethylene triamine, polyisobutylene triethylene tetramine, and polyisobutenyl tetraethylene pentamine.

6. A fuel composition according to claim 1 wherein said acid is formic acid.

7. A fuel concentrate composition having a suitable solvent selected from alkanols and hydrocarbons for admixture with a liquid hydrocarbon fuel and from 5 to 60 weight percent of a salt of a hydrocarbyl-substituted amine, wherein said hydrocarbyl substituent contains from 30 to 300 carbon atoms, and an acid selected from formic, carbonic, acetic and lactic acid.

8. A fuel concentrate composition having a suitable solvent selected from alkanols and hydrocarbons for admixture with a liquid hydrocarbon fuel and from 5 to 60 weight percent of a salt of a hydrocarbyl-substituted alkylene polyamine, wherein said hydrocarbyl substituent contains from 30 to 300 carbon atoms, neutralized from 0.75 to 1 times the amount of titratable amine nitrogen with an acid selected from formic, carbonic, acetic, and lactic acid.

* * * * *